US006343449B1

(12) United States Patent
MacKarvich

(10) Patent No.: US 6,343,449 B1
(45) Date of Patent: Feb. 5, 2002

(54) TENSION STRAP CONNECTOR ASSEMBLY

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 09/490,423

(22) Filed: Jan. 24, 2000

Related U.S. Application Data

(63) Continuation-in-part of application No. 09/282,854, filed on Mar. 31, 1999, now Pat. No. 6,176,056, which is a continuation-in-part of application No. 09/195,468, filed on Nov. 18, 1998, now Pat. No. 5,983,573.

(51) Int. Cl.[7] ..... E02D 27/50

(52) U.S. Cl. ..... 52/293.3; 52/167.3; 52/292; 52/299; 52/DIG. 11; 24/633; 24/545

(58) Field of Search ..... 52/137.3, 23, 150, 52/293.3, 156, 12, 13, 143, 149, 698, DIG. 11, 223.1, 223.2, 225.1, 292, 299; 248/499, 500, 503, 506, 507, 680, 681, 505, 925; 24/230, 192, 199, 311, 317, 633, 545; 403/79, 112, 113

(56) References Cited

U.S. PATENT DOCUMENTS 3,937,436 A * 2/1976 Stewart ..... 248/499
4,003,169 A 1/1977 Young, II
4,257,570 A 3/1981 Rasmussen
5,697,191 A * 12/1997 MacKarvich ..... 52/169.9
5,762,455 A * 6/1998 Long ..... 410/100
5,881,499 A 3/1999 Luzzi
5,983,573 A 11/1999 MacKarvich
6,058,663 A * 5/2000 Mackarvich ..... 52/167.3

* cited by examiner

*Primary Examiner*—Yvonne M. Horton
(74) *Attorney, Agent, or Firm*—Thomas, Kayden, Horstemeyer & Risley

(57) ABSTRACT

A tension strap connector assembly for use in a stabilizing foundation system for a manufactured home supported by at least one flanged beam. The tension strap connector assembly is adapted at a first end so as to hook around and latch about a flange of the manufactured home support beam. At a second end, the tension strap connector has a strap slot adapted to receive a tension strap of the stabilizing foundation system, wherein the tension strap is attached at one end to a ground anchor. The tension strap connector provides a means for altering the orientation of the tension strap relative to the hook portion so that the tension strap can be arranged in non-perpendicular orientations with respect to the manufactured home without creating a torsional stress concentration within the tension strap.

10 Claims, 4 Drawing Sheets

TENSION STRAP CONNECTOR ASSEMBLY

CROSS REFERENCE TO RELATED APPLICATION

This is a continuation-in-part of U.S. Utility patent application Ser. No. 09/282,854, filed Mar. 31, 1999, now U.S. Pat. No. 6,176,056, which is a continuation-in-part of U.S. Utility patent application Ser. No. 09/195,468, filed Nov. 18, 1998, now U.S. Pat. No. 5,983,573.

FIELD OF THE INVENTION

The invention relates generally to a strap connector assembly for use in a manufactured home stabilizing foundation system using tension straps. More particularly, the invention relates to a strap connector assembly which does not create harmful stress concentrations within the tie down straps when the straps are arranged in non-perpendicular orientations with respect to the manufactured home, and which positively latches to the manufactured home frame.

BACKGROUND OF THE INVENTION

Manufactured homes, such as mobile homes, trailers, prefabricated homes, and the like are manufactured at a central manufacturing site and, upon completion, are moved to a location where they are to be occupied. Because these homes are designed to be easily transported from one site to another, they are not built on permanent foundations but, rather, typically are placed on piers such as concrete blocks, pilings, or stabilizing jacks. Normally, the piers directly support the frame of the manufactured home which typically comprises two or more support beams, such as steel I-beams, to which the home is fixedly secured.

If the manufactured home is not anchored securely in position on its piers, the home can be shifted by strong winds or earth tremors which can cause the home to be forced from its foundation. Due to this risk, various types of stabilizing systems have been used for stabilizing the manufactured homes on their piers in order to keep the homes from shifting in response to wind and/or seismic forces. In one particularly effective system, a plurality of tension straps are used to tether the manufactured home to the ground. In these systems, the tension straps typically extend perpendicularly outwardly from incremental positions along the length of the manufactured home. Usually, the tension straps extend downwardly from the support beams of the manufactured home frame to ground anchors that are deeply embedded into the soil. Often, the tension straps are securely connected to the beams with strap connector assemblies that latch onto the support beams. Normally, a strap connector assembly comprise a metal clamp member that includes a hook which securely grips an upper flange of the support beam. The tension straps usually are threaded through a strap slot formed in the clamp member. These strap slots normally are configured so as to be parallel to the hook and the longitudinal direction of the manufactured home, such that the tension straps can be positioned substantially perpendicularly to the longitudinal direction of the manufactured home.

Although functioning adequately under most circumstances, conventional strap connector assemblies present several drawbacks. Most importantly, these strap connector assemblies do not account for longitudinal shifting of the manufactured home due to wind or seismic forces. When a manufactured home shifts under the influence of such forces, the longitudinal position of the strap connector assemblies, and their respective strap slots, likewise shift in the same longitudinal direction. Because the ground attachment points of the tension straps are fixed by the anchors, the tension straps cannot similarly shift longitudinally, thus causing the orientation of the tension straps to become diagonal with respect to the longitudinal direction of the I-beam of the manufactured home. In that the strap slots of the strap connector assembly cannot reorient themselves to accommodate the diagonal orientations of the straps, torsional stresses are concentrated on the straps at the point where the straps connect to the strap connector assemblies. Such stress concentrations can similarly occur in situations in which the tension straps are improperly installed, e.g. In a non-perpendicular orientation relative to the manufactured home. Large stresses can cause failure of one or more of the tension straps, therefore in order to securely fix the home to the foundation it is important to insure that there are no large stresses in the tension straps. Even if torsional stresses do not cause a failure of a strap, torsional stresses can violate the standards stipulated by the United States Department of Housing and Urban Development (HUD) regarding systems for stabilizing foundations. In addition, a shift of the ground anchor in the longitudinal direction coupled with the tension force in the tension strap induces a torque on the strap connector assembly. Such a torque can cause the strap connector assembly to orientate itself so as to relieve the stress, but in doing so the hook of the strap connector assembly is no longer properly secured to the I-beam.

Sometimes it is necessary or convenient to position the ground anchors 20 such that the tension straps 24 are not orientated perpendicular to the longitudinal direction of the I-beam of the home. For example, there may be an obstruction such as an underground pipe or wires, or a large stone, which can be surmounted if the tension strap could be positioned in a non-perpendicular orientation. From the above, it can be appreciated that it would be desirable to have a strap connector assembly which does not create harmful stress concentrations on the tension strap when the strap is orientated in a non-perpendicular orientation with respect to the home. It would also be desirable to have a strap connector assembly that is easily attached to the home within the standards set by HUD, such that when the strap is inadvertently in a non-perpendicular orientation there are no harmful stresses and the stabilized foundation remains in compliance with HUD standards.

U.S. Pat. No. 5,983,573, discloses a device for relieving torsional stresses in a tension strap used in a stabilizing foundation system. The disclosed device includes a clamp member for hooking onto an I-beam of the home and a swivel member coupled to the clamp member by a bolt or pin. While the product of the '573 patent functions properly as intended, this two piece product with its connector bolt is more expensive to produce than a one piece product and requires some adjustment at the site of the manufactured home during installation. The present invention, described in more detail herein below, seeks to overcome these problems, while addressing the problem of relieving torsional stress in the tension strap.

SUMMARY OF THE INVENTION

Briefly described, the present invention relates to a tension strap connector assembly for use in a stabilizing foundation system for a manufactured home which comprises a frame including at least one flanged support beam. The tension strap connector assembly includes a hook portion adapted to latch about a flange of the manufactured home support beam, a strap slot adapted to receive a tension strap of the stabilizing foundation system, and the tension strap which has one end extending through the strap slot. The strap slot is shaped for altering the orientation of the tension strap relative to the hook portion so that the tension strap can be arranged in non-perpendicular orientations with respect to the lengths of the support beams of the manufactured home without once nor eating torsional stresses within the tension strap.

The strap connector assembly includes a connector plate and a rocket bearing. The connector plate includes a body portion having first and second ends, with a hook portion at the first end and strap mounting extension at the second end. The strap mounting extension extends from the body portion and has an opening extending therethrough. The opening has a convex edge distal from the first end of the body portion and is adapted to receive both the rocker bearing and a tension strap. The rocker bearing is formed from a flat strap into a U-shaped body having a pair of legs joined at one end by a concave bend having a concave inner surface and an outer convex surface. The outer convex surface of the rocker bearing provides a curved, rounded bearing surface for engagement by the tension strap. The inner concave surface of the rocker bearing is rectilinear along the transverse length of the rocker bearing, and is adapted to fit loosely around the convex edge of the opening in the connector plate. Due to the rectilinear transverse length of the concave inner bearing surface of the rocker bearing which is matched with and bears against the curvature of the convex edge of the opening in the connector plate, there is only one transverse point of contact between the concave bearing surface of the rocker bearing and the convex edge of the connector plate. This point of contact shifts as the rocker bearing rocks on the convex edge; similar to how the point of contact between a rocking chair and a floor shifts as the chair is rocked. The load of the tension strap is communicated to the rocker bearing, and from the rocker bearing to the connector plate at the movable point of contact.

An advantage of having the rocker bearing rock on the convex edge, instead of having a pivotably mounted swivel member, is that the rocker bearing and the connector plate do not become frozen together. Even when there is rust formed between the rocker bearing and the connector plate, the rust bond is easily broken because there is only one transverse point of contact between the connector plate and the rocker bearing. Whereas, in a device which uses a pin to couple two pieces together, the entire circumference of the pin can become bonded by rust to the coupled pieces, thereby locking the device into one orientation. Also, the connector plate is formed in one piece instead of multiple pieces pivotally connected by a bolt, or other conventional coupling connectors. In addition, the one piece structure is stronger and less expensive to manufacture.

The objects, features, and advantages of this invention will become apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
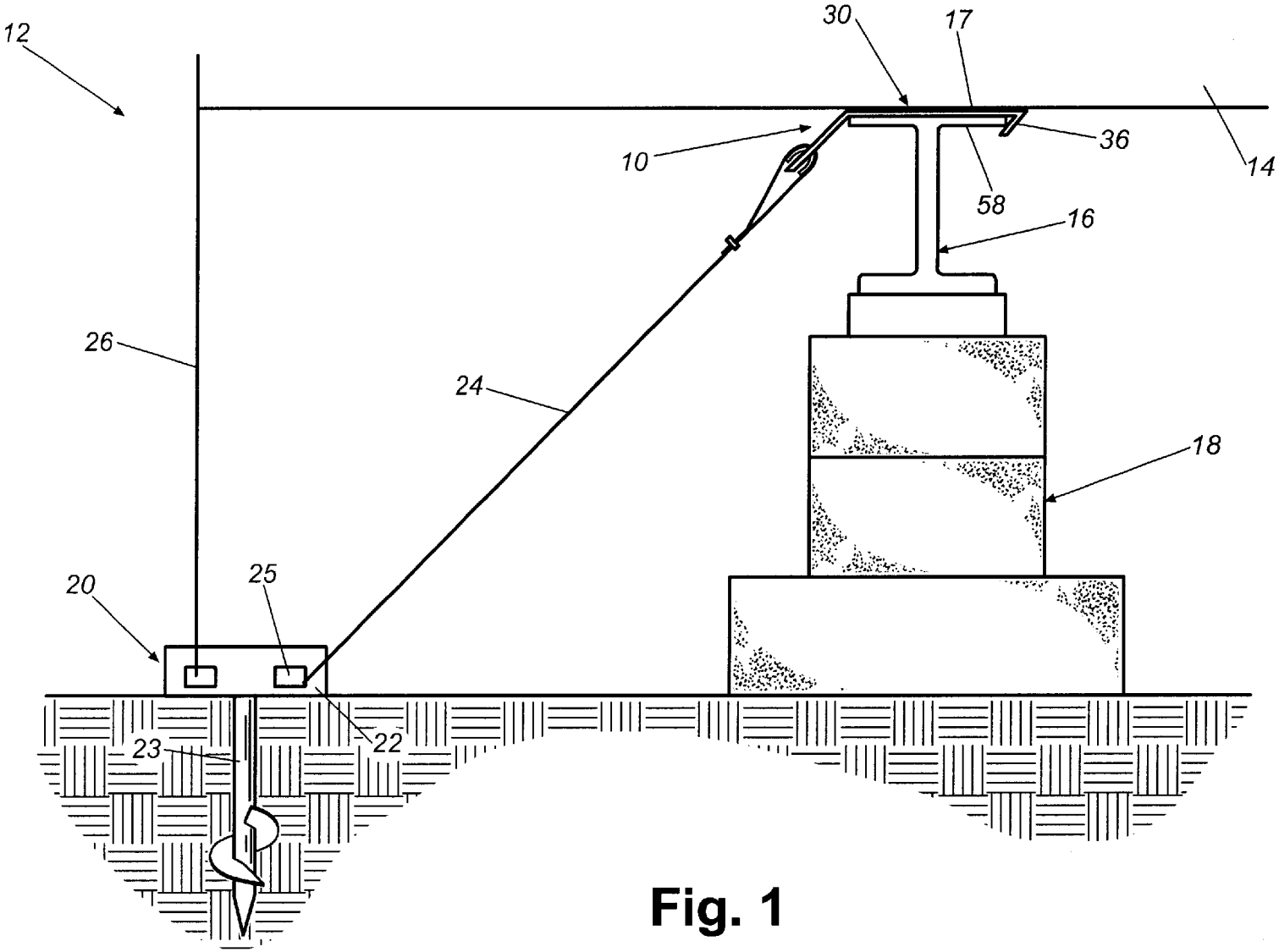
FIG. 1 is a partial end view a manufactured home and manufactured home stabilizing foundation system which includes a strap connector assembly and a tension strap, constructed in accordance with the present invention.

Referring now in more detail to the drawings, in which like reference numerals indicate corresponding parts throughout the several views, FIG. 1 illustrates a tension strap connector assembly 10 as used in a stabilizing foundation system 12 for a manufactured home 14.

As shown in FIG. 1, the manufactured home 14 is supported by a frame which includes at least two parallel support beams 16 and a plurality of support piers 18 aligned along the lengths of the beams 16. Normally, the support beams 16 are formed as steel I-beams and the support piers 18 comprise concrete blocks. The stabilizing foundation system 12 typically comprises a plurality of ground anchors 20, each including a tension head 22 secured to the upper end of a shaft 23 which facilitates attachment of a tension strap 24 to the anchor. The tension straps 24 each are wound in a spiral at its lower end to a bifurcated bolt 25 in the tension head and extend upwardly from its ground anchor 20 to connect to the I-beam 16 of a manufactured home 14. As indicated in FIG. 1, the tension strap 26 can extend from the ground anchor upwardly about the outer periphery of the manufactured home 14 or, in addition or alternatively, a tension strap 24 can connect to the support beams 16 of the manufactured home frame. In the latter case, connection is facilitated by the tension strap connector assembly 10.

Figure 2:
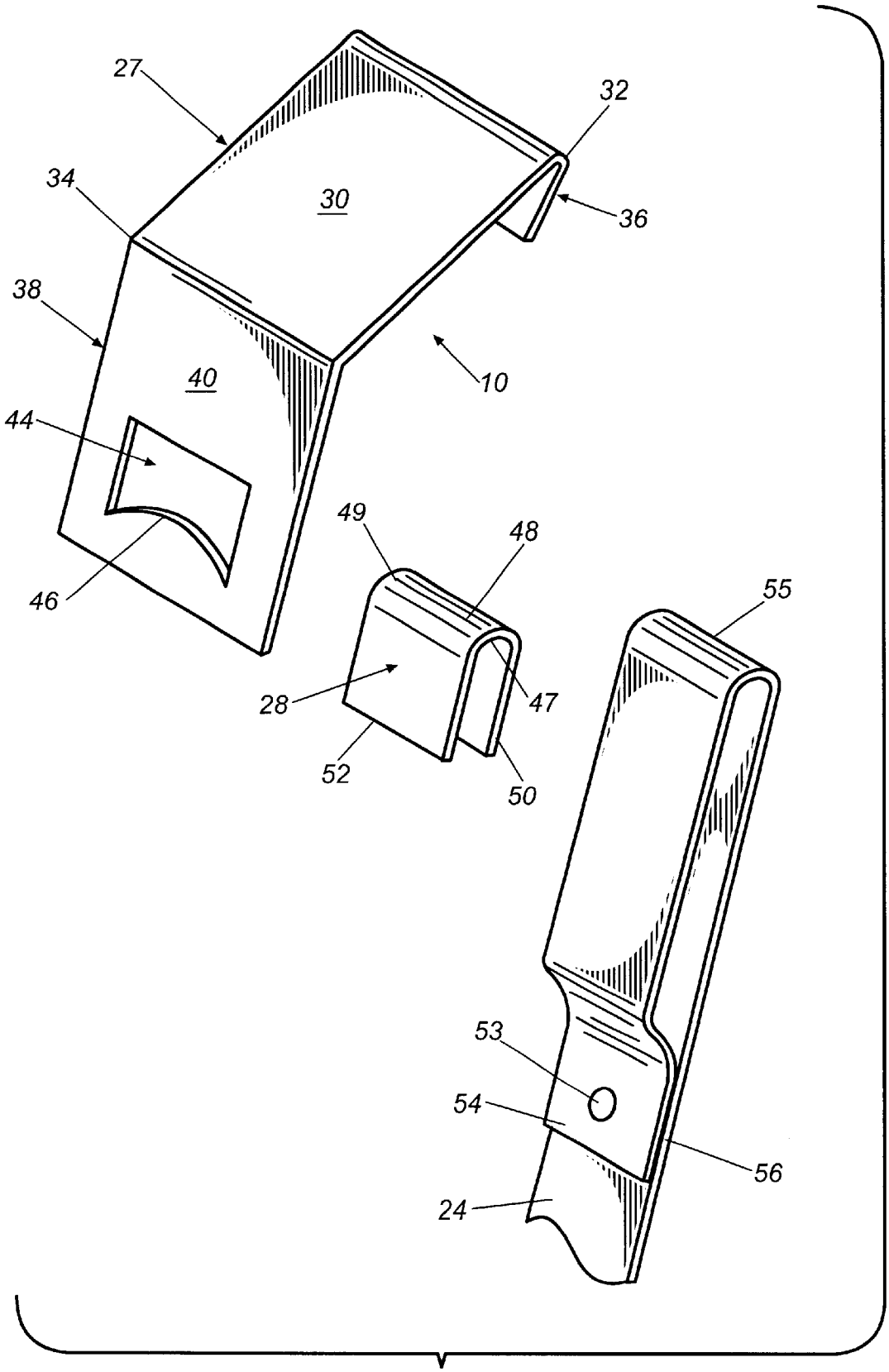
FIG. 2 is an expanded perspective view of the strap connector assembly and a looped end of a tension strap shown in FIG. 1.
Figure 3:
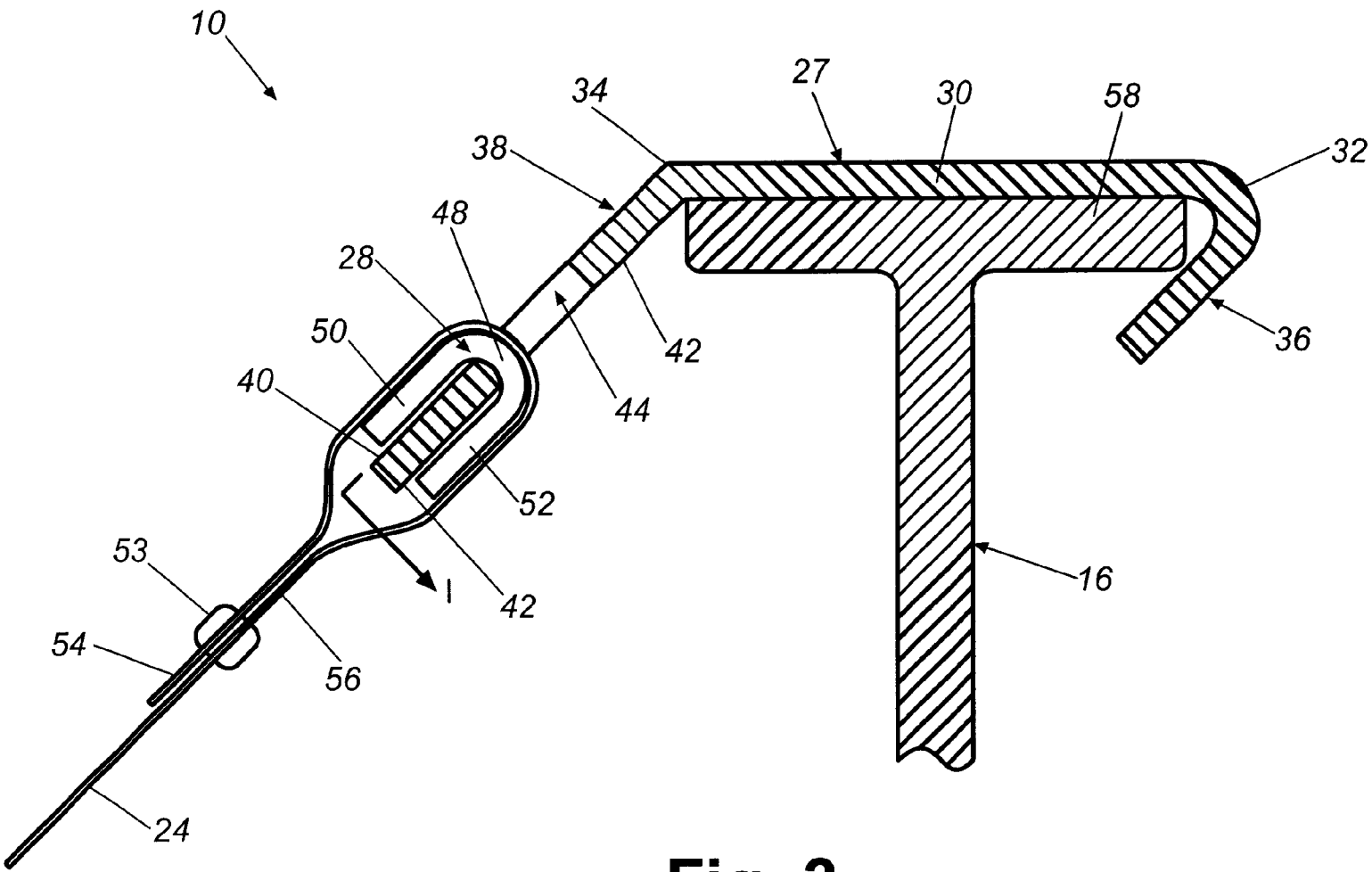
FIG. 3 is a cross sectional side view of the strap connector assembly and a looped end of a tension strap.

FIGS. 2 through 5 illustrate the tension strap connector assembly 10 in more detail. The strap connector assembly 10 generally includes a connector plate 27 and a rocker bearing 28. The connector plate 27 includes a substantially planar body portion 30 having front end 32 and rear end 34. A hook portion 36 extends obliquely at an acute angle from the front end 32 of the body portion 30. A strap mounting extension 38 extends obliquely at an obtuse angle from the rear end 34 of the body portion 30. The strap mounting extension 38 has a top side 40 and a bottom side 42. Like the body portion 30, the hook portion 36 and the strap mounting extension 38 typically are substantially planar in shape. As shown in FIG. 3, the strap mounting extension 38 is contained in a plane that forms an approximately 45° angle with the plane that contains the body portion 30. The strap mounting extension 38 includes an opening 44 for receiving rocker bearing 28 and tension strap 24 shown in FIG. 3. Opening 44 is formed such that an edge 46 is convex shaped, the convex edge 46 is distal from the first end 32 of connector plate 27.

Rocker bearing 28, illustrated in FIGS. 2 and 3, is formed from flat steel strap material and is formed into a U-shape and includes a curved end 48 and first leg 50 and second leg 52 extending therefrom. The curved end 48 has a convex outer surface 49 and a concave inner surface 47. First and second legs 50 and 52 are essentially parallel and adapted to fit loosely around the convex edge 46 of the opening 44 of the connector plate 27 and straddle top and bottom sides 40 and 42 of the strap mounting extension 38.

FIG. 3 illustrates rocker bearing 28 in its operational position with a portion of tension strap 24 inserted longitudinally through opening 44 and folded back over and connected to itself to form a looped end. Tension strap end 54 of tension strap 24 is affixed to portion 56 of tension strap 24 by connector means 53 including welding, bonding, riveting and/or using a nut and bolt, or other conventional connectors. In this manner tension strap 24 is fixedly looped around rocker bearing 28 and connector plate 27, and rocker bearing 28 is prevented from becoming dislodged from between the strap and the connector plate.

Typically, prior art tension straps are received by openings having right angled edges, and consequently when a tension strap is bent around such an edge and tension is applied to the strap a sharp bend radius is produced in the tension strap. Tension straps are more likely to become fatigued and break at sharp radii bends than at bends with larger radii. Therefore, it is desirable to fixedly couple tension strap 24 to strap connector assembly 10 such that there are no sharp radii bends in tension strap 24. Curved end 48 of rocker bearing 28 provides an inner concave surface 47 for bearing against the edge 46 of the opening 44 of the connector plate 27 and an outer convex surface 49 for engagement by the tension strap, thereby providing an essentially smooth rounded external surface around which tension strap 24 is bent. Because tension strap 24 conforms to curved end 48 of the rocker bearing 28, the load from tension strap 24 is communicated to rocker bearing 28 over the entire convex outer surface 49 of curved end 48, instead of being concentrated in a few sharp points of contact.

When strap connector assembly 10 is properly affixed to I-beam 16 of premanufactured home 18, as illustrated in FIG. 3, connector plate 27 is oriented essentially perpendicular to the length of I-beam 16; body portion 30 lies atop the upper flange 58 of the I-beam 16 with hook portion 36 latched about top flange 58. In this configuration, front end 32 of connector plate 27 is essentially parallel to the longitudinal direction of I-beam 16 and body portion 30 of connector plate 27 is configured to lie atop the entire width of I-beam 16, such that second end 34 of the body portion 30 extends beyond or abuts the edge of the upper flange 58 of the I-beam 16. Strap mounting extension 38 extends from second end 34 generally diagonally there down and out.

Figure 5:
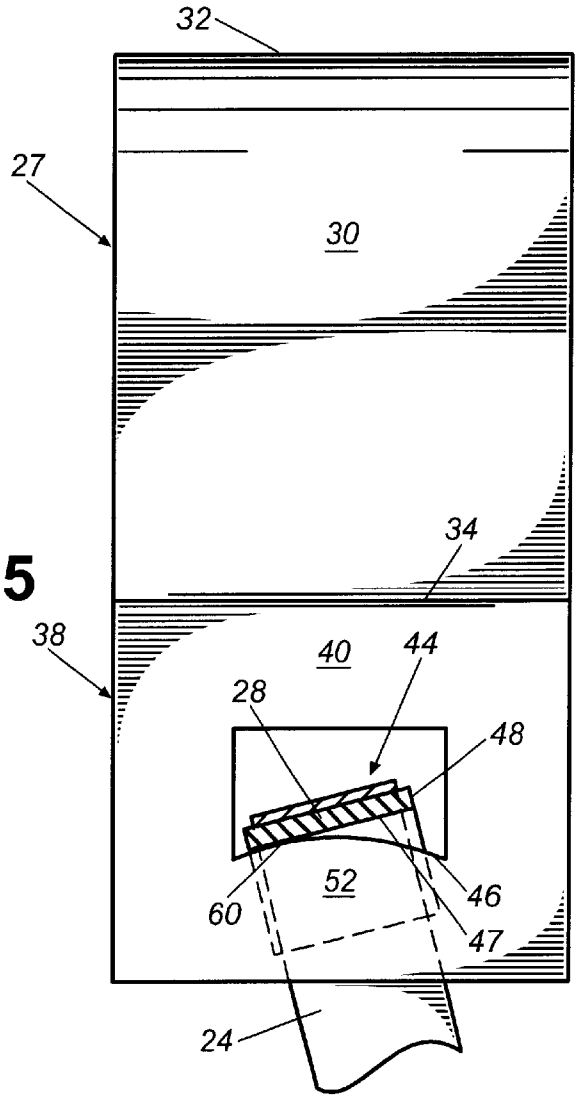
FIG. 5 is a top view of the strap connector assembly, similar to FIG. 4, but showing the tension strap and rocker bearing oriented at an angle from the plane perpendicular to the length of the I-beam.
Figure 4:
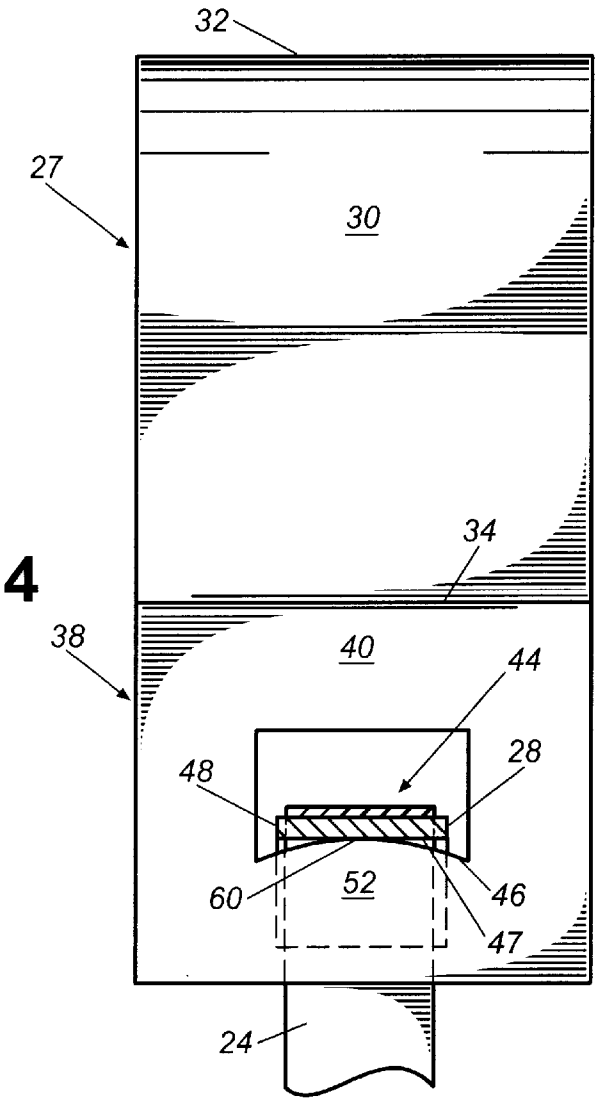
FIG. 4 is a top view of the strap connector assembly with the tension strap oriented perpendicular, to the length of an I-beam to which a home is fixedly secured, and a cross sectional view of the rocker bearing aligned in a plane perpendicular to the length of the I-beam.

Referring now to FIGS. 4 and 5, strap connector assembly 10 is shown from above with a partial cross sectional view of rocker bearing 28 and tension strap 24, with the cross sectional view taken along line I—I in FIG. 3. Strap connector assembly 10 is properly affixed to I-beam 16 (not shown in FIGS. 4 and 5) as described herein above. In FIG. 4 rocker bearing 28 is orientated such that strap 24 extends from connector plate 27 in a plane essentially perpendicular to first end 32 of connector plate 27. FIG. 5 illustrates the orientation of rocker bearing 28 responsive to tension strap 24 being orientated at an non-perpendicular angle to front end 32.

To secure I-beam 16 to stabilized foundation 18 tension strap 24 is attached at one end to anchor 20 and at its other end looped through the opening 44 of the connector plate and around rocker bearing 28. Tension in tension strap 24 pulls rocker bearing 28 onto convex edge 46, such that concave inner surface 47 of curved end 48 between first leg 50 and second leg 52 bears against convex edge 46. As illustrated in FIGS. 4 and 5 the concave inner surface 47 of the curved end 48 is rectilinear in the direction transverse to the curvature of rocker bearing 28, and curved end 48 is in contact with convex edge 46 at only one transverse point, load bearing contact 60. At the point of contact, the load from the tension in tension strap 24 is communicated through rocker bearing 28 to connector plate 27. The tensional force in tension strap 24 can be decomposed into in a horizontal component of force and a vertical component of force. The horizontal component of the tension force pulls the connector plate, such that the hook portion 36 is latched around flange 58 of I-beam 16. The vertical component of the tensional force pulls down on connector plate 27 such that body portion 30 is held against I-beam 16. When the tension is directed in a plane perpendicular to front end 32 of strap connector assembly 10, rocker bearing 28 bears on the vertex of convex edge 46, as illustrated in FIG. 4. Because rocker bearing 28 and convex edge 46 are in contact at only one transverse point, rocker bearing 28 can rock on convex edge 46, and therefore the transverse point of contact can be shifted anywhere along the convex edge 46.

FIG. 5 illustrates the orientation of rocker bearing 28 when strap 24 is angled non-perpendicular to front end 32 of connector plate 27; such an orientation occurs when anchor 20 is displaced along the longitudinal direction of I-beam 16 relative to strap connector 10. The non-perpendicular orientation of tension strap 24 can be the result of longitudinal shifting of the mobile home or the result of improper positioning of the anchor during installation. In either case, the relative displacement of anchor 20 coupled with the tension force in tension strap 24 induces a torque on rocker bearing 28. In response to the torque, the load-bearing contact 60 shifts along the convex edge 46 as rocker bearing 28 changes orientation so as to negate the applied torque. Therefore, torsional stresses in tension strap 24 are substantially reduced, and a possible source of strap failure is reduced.

While preferred embodiments of the invention have been disclosed in detail in the foregoing description and drawings, it will be understood by those skilled in the art that variations and modifications thereof can be made without departing from the spirit and scope of the invention as set forth in the following claims. For example, tension strap 24 can be affixed to rocker bearing 28. All such variations and modifications are intended to be included herein within the scope of the present invention, as set forth in the following claims.

What is claimed is:

1. A strap connector assembly for connecting a strap between an I-beam and a ground anchor with the strap having the ability to extend at an angle other than in a plane oriented at a right angle with respect to the length of the I-beam, comprising:

a connector plate, said connector plate including:

a substantially flat main body segment with opposed side edges for placement in flat abutment with and adapted to extend across an I-beam;

a hook formed at one end of said main body segment of said connector plate and extending toward a first direction from said main body segment and shaped for extending about a side edge of a flange of an I-beam, a sloped strap mounting extension formed at the end of said flat main body section opposite to said hook and extending at an angle sloped toward said first direction for extending at a slope from the flange of an I-beam toward a ground anchor, said sloped strap mounting extension defining a strap connector opening having a convex bearing edge positioned remotely from said hook;

a rocker bearing loosely positioned in said opening of said sloped strap mounting extension and having a rectilinear bearing surface bearing against said convex bearing edge of said strap connector opening for rocking on said convex bearing edge, and a tension strap extending through said strap connector opening and curved about said rocker bearing and arranged to urge said rocker bearing against said convex bearing edge, whereby the rocker bearing is able to rock on said convex bearing edge in response to the tension strap changing positions with respect to said connector plate.

2. The strap connector assembly as described in claim 1, wherein said rocker bearing is approximately U-shaped in cross section and straddles said convex bearing edge.

3. The strap connector assembly as described in claim 1, wherein said rocker bearing has a curved outer surface in communication with a portion of said tension strap curved around said curved end, wherein a load from said tension strap is communicated to a portion of said curved outer surface.

4. A tension strap connector assembly for use in a stabilizing foundation system for a manufactured home which comprises a frame including at least one elongated flanged support beam, said tension strap connector assembly comprising:

a strap slot formed in a connector plate and adapted to receive a tension strap of the stabilizing foundation system; and means for altering the lateral orientation of the tension strap with respect to said connector plate so that the tension strap is in a non-perpendicular orientation with respect to the length of the support beam of the manufactured home without creating a torsional stress concentration within the tension strap.

5. The tension strap connector assembly of claim 4, wherein said connector plate includes a body member and a hook portion is formed on said body member, said body member comprising a substantially flat main body segment with opposed side edges for placement in flat abutment with and adapted to extend across a support beam, said hook portion extending from a first end of said body member in a first direction.

6. The strap connector assembly of claim 4, wherein said strap slot comprises an opening having a least one convex edge, wherein said convex edge is distal from said hook portion.

7. The strap connector assembly of claim 6, wherein said means for altering the lateral orientation of said tension strap comprises a rocker bearing having a rectilinear bearing surface adapted to bear against said convex edge for rocking on said convex edge.

8. The strap connector assembly of claim 7, wherein said rocker bearing is approximately U-shaped in cross section and straddles said convex edge of said strap slot.

9. The strap connector assembly of claim 7, wherein said rocker bearing has a curved convex outer surface bearing against a portion of said tension strap, wherein a load from said tension strap is communicated to said curved outer surface of said rocker bearing.

10. The strap connector assembly of claim 5, wherein connector plate includes a strap mounting extension and said strap slot is formed on said strap mounting extension, said strap mounting extension extends from said body member generally in said first direction.

* * * * *